US005082154A

United States Patent [19]

French

[11] Patent Number: 5,082,154

[45] Date of Patent: Jan. 21, 1992

[54] AID FOR PUTTING ON SOCKS

[76] Inventor: Renee J. French, R.R. 3, Box 155, Grafton, N. Dak. 58237

[21] Appl. No.: 666,946

[22] Filed: Mar. 11, 1991

[51] Int. Cl.[5] ..... A47G 25/90

[52] U.S. Cl. ..... 223/112; 223/111; 223/120

[58] Field of Search ..... 223/111, 112, 120, 113

[56] References Cited

U.S. PATENT DOCUMENTS

| | | | |
|---|---|---|---|
| 2,982,453 | 5/1961 | Zicarelli | 223/112 |
| 3,231,160 | 1/1966 | Glanville | 223/111 |
| 3,715,065 | 2/1973 | Peck | 223/111 |
| 3,853,252 | 12/1974 | Scianiamanico | 223/111 |
| 4,066,194 | 1/1978 | Leland | 223/111 |
| 4,260,083 | 4/1981 | Aslin | 223/111 |
| 4,284,216 | 8/1981 | Leland | 223/111 |
| 4,637,533 | 1/1987 | Black | 223/112 |
| 4,651,909 | 3/1987 | Banting | 223/111 |
| 4,765,520 | 8/1988 | Barton | 223/111 |
| 4,896,803 | 1/1990 | Wilkens | 223/112 |

FOREIGN PATENT DOCUMENTS

| | | | |
|---|---|---|---|
| 343094 | 1/1960 | Switzerland | 223/111 |
| 1442313 | 7/1976 | United Kingdom | 223/111 |
| 2173390 | 10/1986 | United Kingdom | 223/111 |

*Primary Examiner*—Werner H. Schroeder
*Assistant Examiner*—Bibhu Mohanty
*Attorney, Agent, or Firm*—Henderson & Sturm

[57] ABSTRACT

An apparatus for assisting an individual in donning hosiery (100). The apparatus (10) includes a base member (13) operatively attached to a three legged hosiery support unit (12) having two angled side legs supporting members, (16, 17) and an angled rear support leg member (15) which suspend and expands the opening (102) of an article of hosiery (100) to accept the insertion of the user's foot (50).

4 Claims, 1 Drawing Sheet

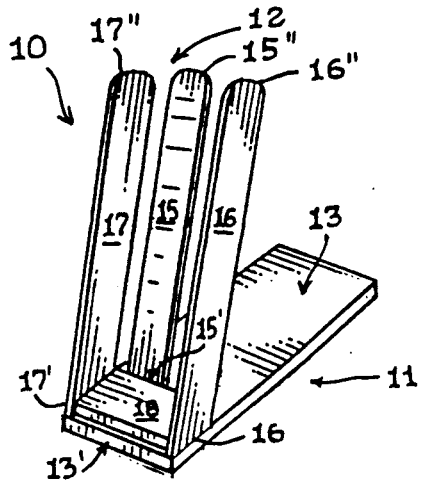
FIG. 1.
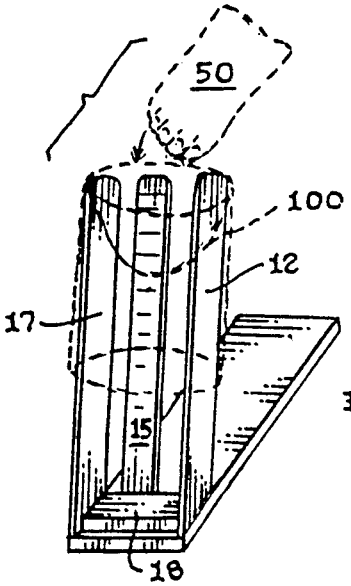
FIG. 2.
FIG. 3.
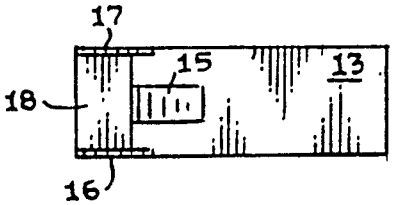
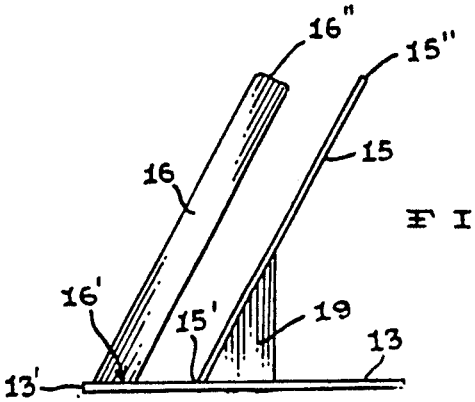
FIG. 4.
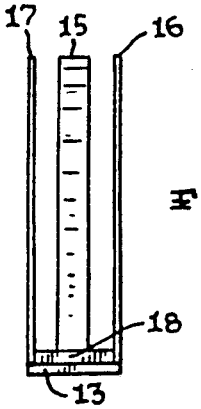
FIG. 5.

AID FOR PUTTING ON SOCKS

TECHNICAL FIELD

The present invention relates to the field of devices for assisting an individual in the act of putting on their socks or stockings, and in particular to a three legged stationary apparatus for positioning a sock prior to insertion of the user's foot.

BACKGROUND ART

This invention was the subject matter of Document Disclosure Program Registration No. 257,395 filed in the U.S. Patent and Trademark Office on July 2, 1990.

As can be seen by reference to the following U.S. Pat. Nos. 2,982,453; 4,637,533; 4,651,909; and 4,896,803; the prior art is replete with myriad and diverse devices for assisting an individual in putting on their socks or stockings.

While all of the aforementioned prior art constructions are more than adequate for the basic purpose and function for which they have been specifically designed, these patented devices are also uniformly deficient with regard to either their simplicity of construction, ease of use and for practicality.

Obviously, if an individual has difficulty due to age, obesity or ill health in putting on their socks or stockings, they will want a device that is simple to use and reliable, as well as one that is inexpensive and practical.

As a consequence of the foregoing situation, there has existed a longstanding need for a free standing, lightweight aid to assist an individual in putting on their socks or stockings one foot at a time. The device is dimensioned and contoured so as to simplify the task, and the provision of such a construction is a stated objective of the present invention.

DISCLOSURE OF THE INVENTION

Briefly stated, the apparatus for assisting an individual in putting on hosiery comprises a base unit and a three legged hosiery support unit. The base unit comprises in general, an elongated base member which provides support for the housing support unit.

In addition, the housing support unit comprises a rear support leg member and two side support leg members. All of the support leg members are operatively secured proximate the front end of the base member.

As will be explained in greater detail further on in the specification, the two side support leg members are provided with a cross-piece brace element and the rear support leg member is provided with a generally triangular shaped brace element. The leading edges of the support leg members are angularly and rearwardly disposed relative to the front end of the base member to facilitate the insertion of a user's foot into a sock suspended and supported from the tops of the support leg members.

BRIEF DESCRIPTION OF THE DRAWINGS

These and other attributes of the invention will become more clear upon a thorough study of the following description of the best mode for carrying out the invention, particularly when reviewed in conjunction with the drawings, wherein:

FIG. 1 is an isolated perspective view of the apparatus that forms the basis of the present invention;

FIG. 2 is a perspective view of the apparatus showing a hosiery article operatively deployed thereon;

FIG. 3 is a top plan view of the apparatus;

FIG. 4 is a side plan view of the apparatus; and

FIG. 5 is a front plan view of the apparatus.

BEST MODE FOR CARRYING OUT THE INVENTION

As can be seen by reference to the drawings, and in particular to FIG. 1, the apparatus for assisting an individual in donning hosiery that forms the basis of the present invention is designated generally by the reference numeral (10). The apparatus (10) comprises in general a base unit (11), and a three legged hosiery support unit (12). These units will now be described in seriatim fashion.

As can best be seen by reference to FIGS. 3 and 4, the base unit comprises an elongated generally rectangular base member (13) fabricated preferably from a relatively strong material such as wood, plastic, or metal.

Turning now to FIGS. 1 and 5, it can be seen that the hosiery support unit (12) comprises a rear support leg member (15) and two side support leg members (16, 17). Each of the support leg members (15, 16, 17) has an elongated generally flat, thin, profile. In addition, each of the support leg members (15, 16, 17) is operatively connected on their lower ends (15', 16', 17') to the base member (13). The upper ends (15'', 16'', 17'') of the leg members (15, 16, 17) are provided with rounded edges whose purpose will be described presently.

As shown in FIGS. 3–5, each of the side support leg members (16, 17) is attached to the base member (13) proximate the front (13') of the base member (13). The side support leg members (16, 17) are aligned generally parallel to one another and angled rearwardly relative to the front (13') of the base member (13).

In addition, the side support leg members (16, 17) are further provided with a cross-piece element (18) secured to the base member (13) and operatively connected on each end to one of the side support leg members (16, 17).

Still referring to FIGS. 3–5, it can be seen that the rear support leg member (15) is disposed at a location proximate to, but spaced from the front (13') of the base member (13), as well as the trailing edges of each of the side support leg members (16, 17). The rear support leg member (15) is disposed intermediate the side support leg members (16, 17). The lateral axis of the rear support leg member (15) is disposed generally perpendicular to the lateral axis of the side support leg members (16, 17).

Furthermore, as shown in FIGS. 4 and 5, the longitudinal axis of all of the support leg members (15, 16, 17) are disposed parallel to one another at an angular orientation of approximately 22° with respect to the vertical plane. As can also be seen particularly with respect to FIG. 4, the rear support leg member (15) is further provided with a generally triangular brace element (19) secured to the base member (13) and the back surface of the rear support leg member (15) to maintain the longitudinal axis of the rear support leg member (15) at the proper angular orientation.

As shown in FIG. 2, when a user wants to slip one of their feet (50) into an article of hosiery (100), all that is required is for the user to slip the sides of the article of hosiery over the rounded edges of the tops (15'', 16'', 17'') of the support leg members (15, 16, 17) to create an expanded opening in the inverted articles of hosiery (100).

Then the user inserts their foot (50) into the expanded opening (102) and pushes downwardly which will cause the sides (101) of the inverted article of hosiery (100) to progressively cover the user's foot (50).

By now it should be appreciated that the angular orientation of the longitudinal axis, as well as the angular off-set of the lateral axis of the support leg members (15, 16, 17) greatly simplifies and facilitates the donning of hosiery by virtue of the ergonomic features of the apparatus (10). It should also be apparent that the rounded edges on the tops (15'', 16'', 17'') are provided to prevent the hosiery material from snagging as the article of hosiery (100) slips onto the user's foot (50).

Having thereby described the subject matter of the present invention, it should be apparent that many substitutions, modifications and variations of the present invention are possible in light of the above teachings. It is therefore to be understood that the invention as taught and described herein is only to be limited to the extent of the breadth and scope of the appended claims.

I claim:

1. An apparatus to assist an individual in donning an article of hosiery wherein the apparatus comprises:

a base unit including an elongated base member having a front and a rear;

a hosiery support unit including a plurality of generally elongated thin flat support leg members including a rear support leg member and a pair of opposed side support leg members operatively attached to the base member proximate to said front wherein the longitudinal axis of said plurality of support leg members are disposed generally parallel to one another and are angled rearwardly relative to said front of the base member; wherein the lateral axis of at least one of said plurality of support leg members is disposed perpendicular to the lateral axis of one other of said plurality of support leg members.

2. The apparatus as in claim 1 wherein the pair of side support leg members are disposed proximate the front of said base member.

3. The apparatus as in claim 2 wherein said rear support leg member is disposed proximate to, but spaced from the front of said base and the pair of side support leg members.

4. The apparatus as in claim 3 wherein the lateral axis of said rear support leg member is disposed generally perpendicular to the lateral axis of each of said side support leg members.

* * * * *